US007670236B2

(12) United States Patent
Kajita

(10) Patent No.: US 7,670,236 B2
(45) Date of Patent: Mar. 2, 2010

(54) CLUB HEAD FOR IRON GOLF CLUB

(75) Inventor: Ryota Kajita, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 91 days.

(21) Appl. No.: 11/930,327

(22) Filed: Oct. 31, 2007

(65) Prior Publication Data

US 2008/0161126 A1 Jul. 3, 2008

(30) Foreign Application Priority Data

Dec. 27, 2006 (JP) ..... 2006-352180

(51) Int. Cl.
*A63B 53/04* (2006.01)

(52) U.S. Cl. ..... 473/346; 473/350

(58) Field of Classification Search ..... 473/324–350
See application file for complete search history.

(56) References Cited

U.S. PATENT DOCUMENTS

| | | | | |
|---|---|---|---|---|
| 3,814,437 | A * | 6/1974 | Winquist | 473/350 |
| 3,893,672 | A * | 7/1975 | Schonher | 473/328 |
| 3,955,820 | A * | 5/1976 | Cochran et al. | 473/337 |
| 5,160,137 | A | 11/1992 | Katayama | |
| 5,547,194 | A * | 8/1996 | Aizawa et al. | 473/350 |
| 5,547,426 | A * | 8/1996 | Wood | 473/290 |
| 5,643,112 | A * | 7/1997 | Besnard et al. | 473/350 |
| 5,669,826 | A * | 9/1997 | Chang et al. | 473/332 |
| 5,711,722 | A * | 1/1998 | Miyajima et al. | 473/346 |
| 5,762,566 | A * | 6/1998 | King et al. | 473/328 |
| 6,193,614 | B1 * | 2/2001 | Sasamoto et al. | 473/329 |
| 6,224,494 | B1 * | 5/2001 | Patsky | 473/253 |
| 6,659,882 | B2 * | 12/2003 | Patsky | 473/292 |
| 6,695,712 | B1 * | 2/2004 | Iwata et al. | 473/291 |
| 6,780,123 | B2 | 8/2004 | Hasebe | |
| 6,899,638 | B2 * | 5/2005 | Iwata et al. | 473/329 |
| 6,984,180 | B2 * | 1/2006 | Hasebe | 473/291 |
| 6,991,559 | B2 * | 1/2006 | Yabu | 473/332 |
| 7,144,337 | B2 * | 12/2006 | Hirano | 473/342 |
| 7,431,665 | B2 * | 10/2008 | Sugimoto | 473/342 |
| 7,479,070 | B2 * | 1/2009 | Hirano | 473/345 |
| 7,588,502 | B2 * | 9/2009 | Nishino | 473/332 |
| 2004/0224785 | A1 | 11/2004 | Hasebe | |

FOREIGN PATENT DOCUMENTS

| | | | |
|---|---|---|---|
| JP | 8-168541 | A | 7/1996 |
| JP | 11347158 | A * | 12/1999 |
| JP | 2001-29521 | A | 2/2001 |

(Continued)

*Primary Examiner*—Alvin A Hunter
(74) *Attorney, Agent, or Firm*—Sughrue Mion, PLLC

(57) ABSTRACT

An iron club head for an iron golf club, includes: an upper portion of a face member; and a lower portion of the face member, wherein: a maximum height (H) on the face member at which a ball is to be hit is obtained by an equation: H=Rb×(1−sin(loft angle−8)+DP/2×cos(loft angle) where, Rb: ball radius (21.4 mm), and Dp: strike mark diameter (15 mm); the upper portion is arranged upper than the height (H) obtained by the equation as a boundary; and a thickness of the upper portion, excluding a circumferential edge, is formed thinner than a thickness of the lower portion, the thickness of the upper portion being made to be 1±0.2 mm (0.8 to 1.2 mm).

8 Claims, 8 Drawing Sheets

FOREIGN PATENT DOCUMENTS

| | | | | |
|---|---|---|---|---|
| JP | 2001-212270 | A | | 8/2001 |
| JP | 2002000772 | A | * | 1/2002 |
| JP | 2002-85607 | A | | 3/2002 |
| JP | 2002186692 | A | * | 7/2002 |
| JP | 2005124745 | A | * | 5/2005 |
| JP | 2005-279093 | A | | 10/2005 |

* cited by examiner

CLUB HEAD FOR IRON GOLF CLUB

BACKGROUND OF THE INVENTION

1. Field of the Invention

The present invention relates to an iron club head for an iron golf club in which the thickness of a face of the club head is partially changed to be different.

2. Description of the Related Art

Conventionally, thicknesses of faces of club heads have been designed from the view point of strength and impact function. The thickness distribution of a club head is designed in such a way that firstly, a minimum required thickness for the face is designed which can bear an impact resulting at impact from the view point of strength, and following this, the position of center of gravity is designed, which is followed by the design of a sweet area. In designing the thickness distribution like this, the sixth sense and experience have played an important role in many cases, and in particular, in the design of the minimum required thickness, a process has been adopted in which a thickness is calculated which is required as a minimum when an impact is received at the center of the face and is then determined through verification by means of durability tests. In addition to this, when an importance is attached to the idea of low center of gravity, technical know-how depending upon the sixth sense has been made full use of to the thickness of a portion of the face lying in the vicinity of the sole is increased or to use materials of higher specific gravities in combination in the relevant portion. As club heads in which the thickness of the face surface portion is partially changed to obtain the low center of gravity and good striking feel, club heads described, for example, in JP-A-2005-279093 and JP-A-2001-29521 have been known.

However, an attempt was made in the past to design the low center of gravity in a more rational way. It was a design method of designing golf clubs with a low-toe type club head which were represented by a Browning golf club. Briefly describing, it was an idea that no face was necessary on a portion of a club head where there was no contact with a ball, and what resulted was a unique design in which a portion of a top part of the club head which lies on a toe side thereof was cut away and furthermore, the overall height of the club head was reduced. Golf clubs of this type were well supported and used by not only golfers in general but also professional golfers as a driving iron. However, golf clubs of this type disappeared from the market, because the golf industry then was too conservative to accept them and the unique design was not well accepted generally, and the trajectory became unstable in the vertical direction due to reduced inertial moment which resulted from lowering the center of gravity extremely too low.

SUMMARY OF THE INVENTION

Neither of the club heads described in JP-A-2005-279093 and JP-A-2001-29521 attains a low-center-of-gravity performances, which is as good as that of the club heads of the low-toe type. Further, the club heads of the low-toe type have the above-mentioned drawbacks.

Aspects of the invention relate to an iron club head for a conventionally shaped iron golf club which has a low-center-of-gravity performance such as provided by the low-toe type club heads and attains an increase in inertial moment around a horizontal axis thereof.

According to an aspect of the invention, there is provided an iron club head for an iron golf club including: an upper portion of a face member; and a lower portion of the face member, wherein: a maximum height (H) on the face member at which a ball is to be hit is obtained by an equation: H=Rb×(1−sin(loft angle−8)+DP/2)×cos(loft angle) where, Rb: ball radius (21.4 mm), and Dp: strike mark diameter (15 mm); the upper portion is arranged upper than the height (H) obtained by the equation as a boundary; and a thickness of the upper portion, excluding a circumferential edge, is formed thinner than a thickness of the lower portion, the thickness of the upper portion being made to be 1±0.2 mm (0.8 to 1.2 mm).

According to the aspect of the invention, the feeling of disorder with respect to the shape of the club head is no more sensed, the center of gravity of the club head is lowered sufficiently, and the vertically unstable trajectory due to the reduction in inertial moment is resolved.

DETAILED DESCRIPTION OF THE EMBODIMENTS

Hereinafter, exemplary embodiments of the invention will be described by reference to the drawings.

Figure 1:
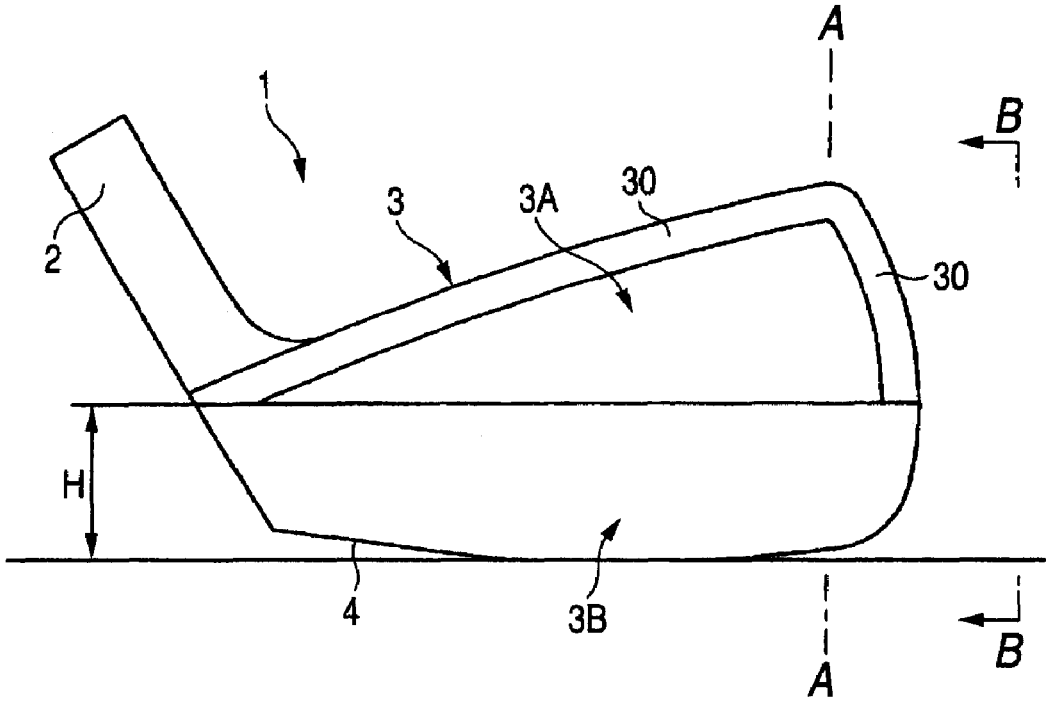
FIG. 1 is a back view of an iron club head according to one aspect of the invention.

FIG. 1 is a back view of an iron club head for an iron golf club (for example, a 5-iron) according to one exemplary embodiment of the invention, a face member 3 is formed in such a manner as to be connected to a hosel 2 so as to make up a club head main body 1. A maximum height at which a ball is hit by the face member 3 of the club head main body 1 is obtained by the following equation:

$$H=Rb\times(1-\sin(\text{loft angle}-8))+DP/2\times\cos(\text{loft angle})$$

where, Rb denotes a ball radius (21.4 mm), and Dp denotes a strike mark diameter (15 mm). Let a horizontal line which passes through the height H be X, an upper portion 3A, excluding a circumferential edge 30, of the face member 3 which lies upper than the horizontal X as a boundary is formed to a thickness of 1±0.2 mm (0.8 to 1.2 mm). In addition, a lower portion 3B of the face member 3 which lies lower than the horizontal line X is formed in such a manner as to have a thickness which is thicker than that of the upper portion 3A.

Figure 2:
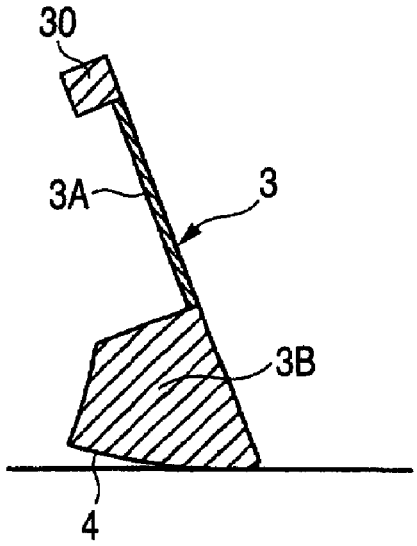
FIG. 2 is a sectional end view taken along the line A-A in FIG. 1.

FIG. 2 is a sectional end view taken along the line A-A in FIG. 1, which shows a relationship in thickness among the upper portion 3A, the lower portion 3B and the circumferential edge 30 of the face member 3.

Figure 3:
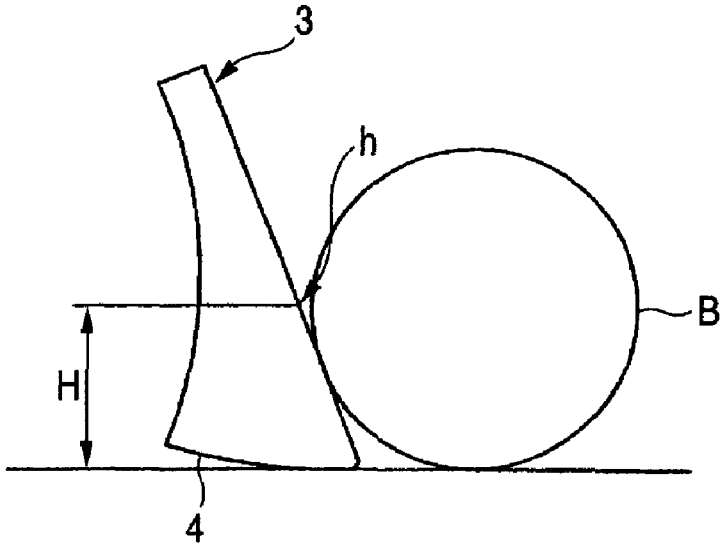
FIG. 3 is a view as seen in a direction indicated by arrows B in FIG. 1.
Figure 4:
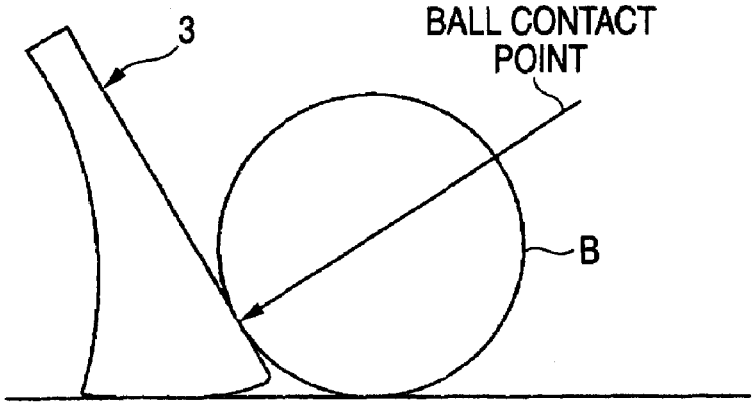
FIG. 4 is an explanatory view of a ball contact point.
Figure 5:
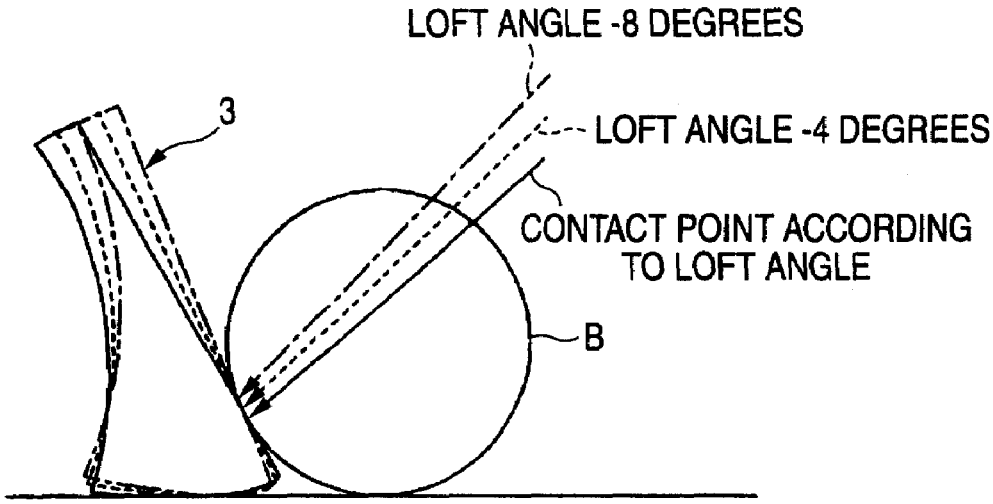
FIG. 5 is an explanatory view of a ball contact point when a ball is actually hit.

FIG. 3 is an end view as seen in a direction indicated by arrows B in FIG. 1, which shows a maximum height position h where a ball B is hit by a face surface of the face member 3. According to the above equation, this height position h is 20.3 mm (in the case of the 5-iron) from a sole 4 which is in touch with the ground. The ball B is to be hit by a portion of the face surface which lies lower than the position h. An area lying upper than the height H (the position h on the face surface), that is, the upper portion 3A of the face member 3 does not have to have a strength which is as good as that of the lower portion 3B but only has to have a thickness which is sufficient to hold the conventional club head shape. Then, a conventional club head shape is adopted in which a thickness of the portion (the upper portion 3A) which does not contact or hit the ball B is made to be 1 mm or thinner, and the design concept of "low-toe" (a shape in which an upper side of a toe portion of a general iron club head is deleted) is carried over so as to eliminate the feeling of disorder sensed with respect to the low-toe type club heads in the past, and what results therefrom is a club head shown in FIGS. 1 to 3. In addition, in order to attain an increase in inertial moment around a horizontal axis, a thickness of an edging portion (the circumferential edge 30) which constitutes the farthest portion of the club head shape in a contour of the club head shape is made to remain substantially the same as that of the conventional club heads, which is on the order to 6±2 mm (4 to 8 mm), to thereby suppress the reduction in inertial moment around the horizontal axis to a minimum level.

The portion on the face surface which lies upper than the height H or the position h on the face surface makes up the portion "where the ball is not hit," and the meaning of "where the ball is not hit" will be described below. In the event that an impact is completed according a loft angle of a club as is shown in FIG. 3, a ball B comes into contact, in no case, with the club face at a portion above a ball contact point. On the other hand, it is well known that when the ball B is hit with a piece of pressure-sensitive paper affixed to the club face, there remains on the piece of paper a strike mark of a diameter of 10 to 15 mm. The portion where the strike mark remains is the portion where force was generated at the time of impact, and hence, the portion requires a strength which can bear the force. Consequently, the portion of the club face which lies upper than the strike mark makes up "where the ball is not hit."

The ball contact point can easily be obtained by the following equation in a geometrical fashion.

$$\text{Ball contact height} = Rb \times (1 - \sin(\text{loft angle}))$$

where Rb denotes a ball radius (21.4 mm)

Since the portion above the strike mark is "where the ball is not hit," a portion makes up "where the ball is not hit" which expands upwards to a position lying higher by a half the diameter of the strike mark than the contact height on the face surface. However, when an actual hitting test was carried out to verify the above, it was found out that strike points were generated in positions higher than the portion defined as described above, and the results of the test were analyzed by use of high-speed photography for a cause for the results of the actual hitting test. As a result of the analysis, it was found that there were few golfers who hit balls according the loft angles of the golf clubs but due to the so-called hand-first, actual impacts occurred at angles which are less by 4 to 8 degrees than the loft angle, whereby the strike marks were left in the positions higher than the position calculated in the way described above.

Consequently, a maximum height of "where the ball is not hit" is defined as below:

$$\text{Maximum height} = Rb \times (1 - \sin(\text{loft angle} - 8)) + DP/2 \times \cos(\text{loft angle})$$

where, Rb: ball radius (21.4 mm), Dp: strike mark diameter (15 mm).

Figure 6:
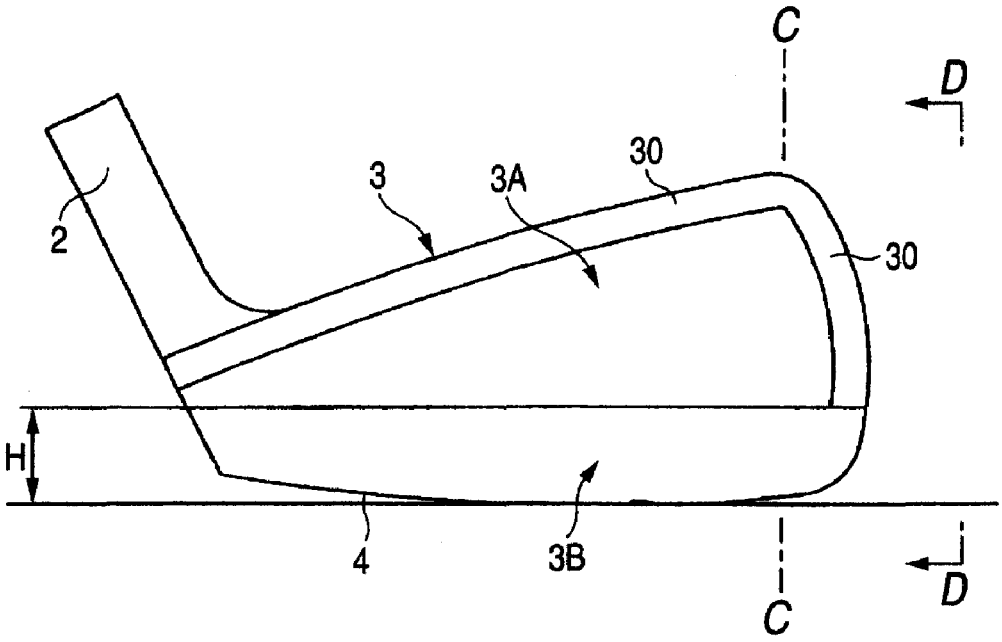
FIG. 6 is a back view of a club head according to another aspect of the invention.
Figure 7:
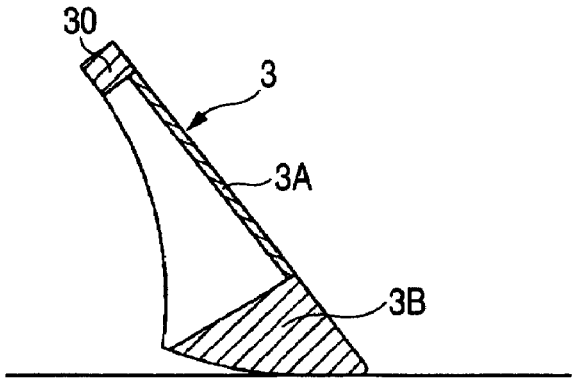
FIG. 7 is a sectional end view taken along the line C-C in FIG. 6.

Next, according to another exemplary embodiment of the invention, there is provided a club head for a general 9-iron, as shown in FIGS. 6 and 7. In this example, the height H is 14.1 mm. When compared with the 5-iron shown in FIGS. 1 to 3, a heavy portion (the lower portion 3B) is reduced largely, whereas an area of 1 mm thick where the ball is not hit (the upper portion 3A) is increased largely. From this, a tendency can be anticipated in which with irons higher in number, the center of gravity is remarkably lowered. Furthermore, in order to secure a predetermined club head weight, the sole width has to be increased as the number in irons increases, or materials having high specific weights can be used in the vicinity of the sole, and it is also seen from this that lowering the center of gravity is promoted more and more with irons higher in number.

Figure 8:
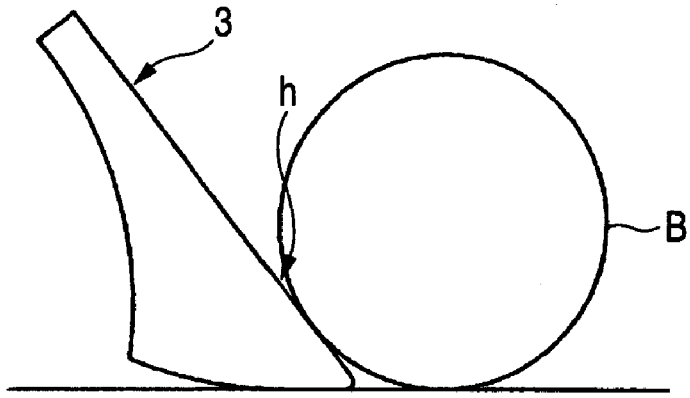
FIG. 8 is a view as seen in a direction indicated by arrows D in FIG. 6.
Figure 9:
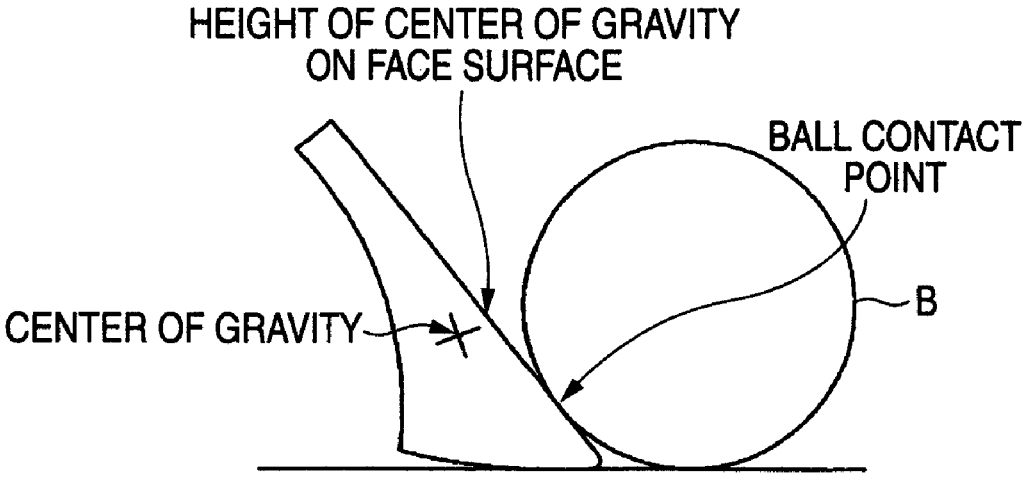
FIG. 9 is an explanatory view which explains a relationship between ball contact points and positions of centers of gravity.
Figure 10:
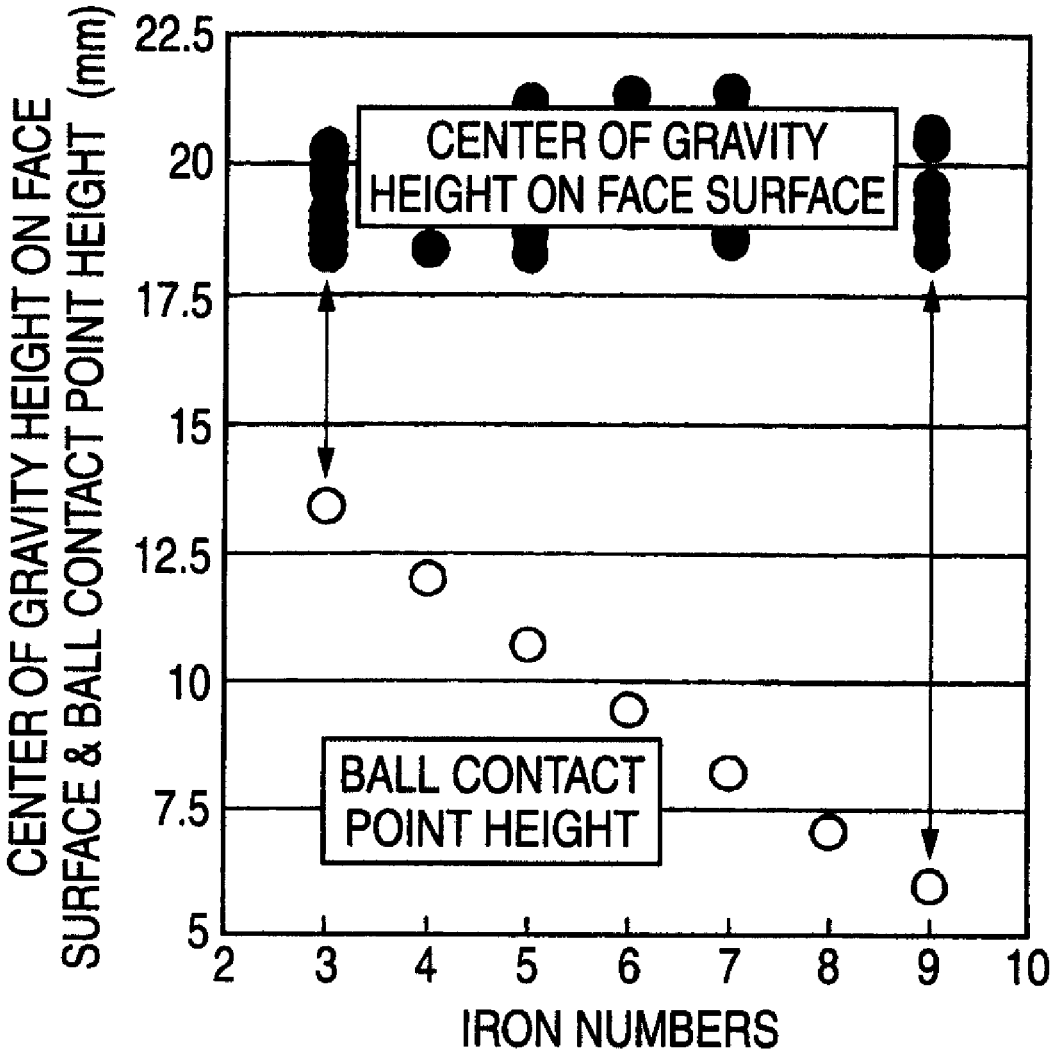
FIG. 10 is a graph showing the results of a measurement of a relationship between ball contact points and positions of centers of gravity on a set of commercially available clubs.

On the other hand, as is seen from a comparison between FIGS. 3 and 8, the height of the contact point between the ball B and the face surface is lowered as the number in irons increases. According to the geometric criterion on lowering the center of gravity of the invention, as has been described above, the height of the center of gravity is lowered as the number in irons increases. In general, when considering the relationship between the strike point (the ball contact point) and the position of the center of gravity on the face surface, it is said that the center of gravity is too high as is shown in FIG. 9. Then, heights of center of gravities of club heads of a set of commercially available irons were measured for study of the positional relationship between the ball contact point (the strike point) and the center of gravity on the face surface, and the results of the study are shown in a graph in FIG. 10. The height of the center of gravity on the face surface means the height of a point which results when a perpendicular is drawn from the center of gravity down on to the face surface. Referring to FIG. 10, as has been mentioned conventionally, when contact points (hereinafter, referred to as strike points) between the ball and the club face are compared, it is seen that positions of the centers of gravity on the face surfaces are too high. Moreover, the deviation increases as the number in irons increases, clubs are shorter for which more accurate hitting is required, and it is seen from this that it is more important to lower the height of the center of gravity than to increase the inertial moment. This means that even though the inertial moment is increased as required, in case the off-center amount is large, the inertial moment does not work properly On the contrary, in case the strike point and the point of center of gravity coincide with each other, no matter how small the inertial moment is, there is not much affected thereby. Consequently, the invention becomes effective as the number in irons increases.

Figure 11:
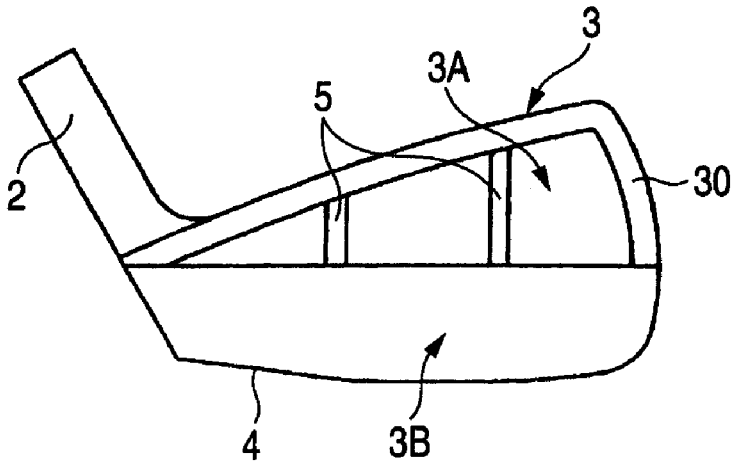
FIG. 11 is a back view showing an example in which two ribs are provided on a back of an upper portion.
Figure 12:
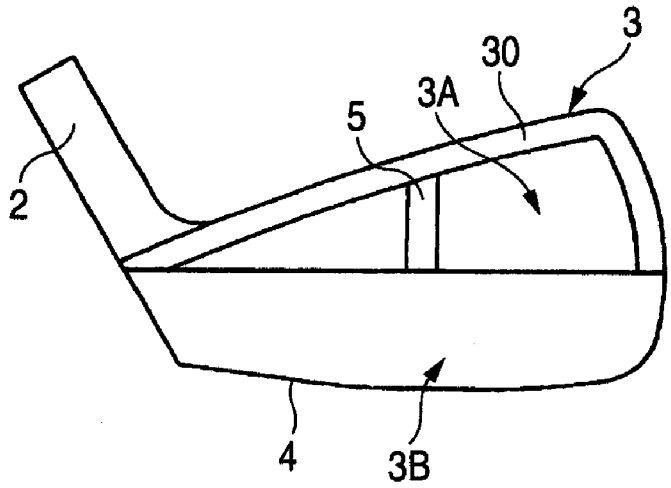
FIG. 12 is a back view showing an example in which one rib is provided on the back of the upper portion.

FIGS. 11 and 12 show examples in which ribs 5 are provided in the upper portion 3A. Although it is agreed that the portion (the upper portion 3A) on the club face where the ball B is not hit does not have to be thick, the club head main body 1 is damaged by not only the impact but also force applied thereto when a golf bag containing the relevant golf club falls. Because of this, countermeasures need to be taken against this. To this end, in FIG. 11, ribs 5 of 3 mm wide and 3 mm high are disposed in a thin portion (the upper portion 3A) to reinforce an area of 1 mm thick in such a manner as to divide equally the thin portion into three. In addition, in FIG. 12, a rib 5 of 5 mm wide and 3 mm high is disposed in the thin portion to reinforce the area of 1 mm thick in such a manner as to divide equally the thin portion into two. In each of the cases, the ribs 5 are disposed in such a manner as to connect a circumferential edge 30 with a lower portion 3B.

Figure 13:
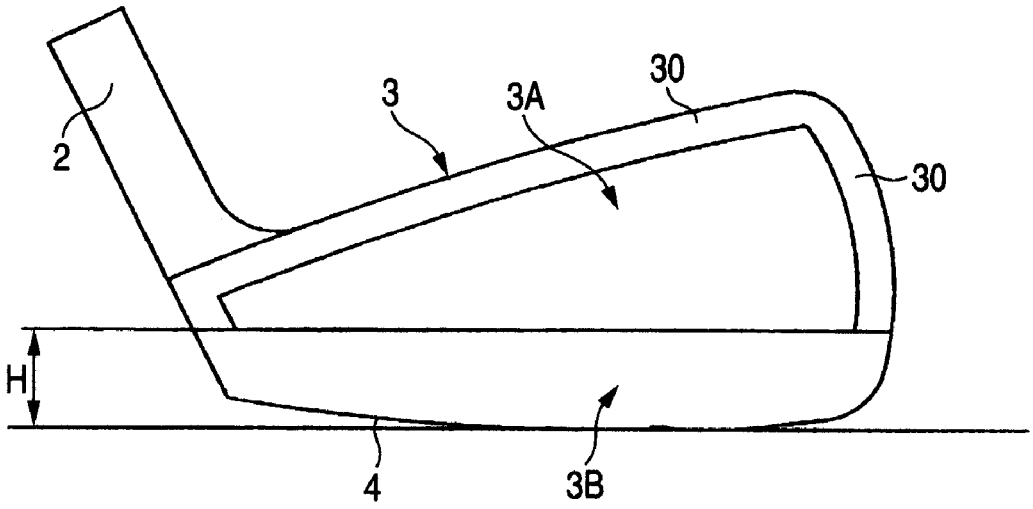
FIG. 13 is a back view of a club head according to another aspect of the invention.

Further, as shown in FIG. 13, an end portion of a hosel side of the edging portion (the circumferential edge 30) may be formed nearly along an axial direction of the hosel.

Note that the face member 3 can be made integrally by forging a soft iron, be made of other metals, or be made up of a combination of different types of materials. As is described in JP-A-2001-29521, the lower portion 3B can be constructed into a double-layer configuration.

What is claimed is:

1. An iron club head for an iron golf club, comprising:

an upper portion of a face member;

a lower portion of the face member, and at least one rib that connects the circumferential edge of the upper portion with the lower portion, wherein:

a maximum height (H) on the face member at which a ball is to be hit is obtained by an equation: H=Rb×(1−sin(loft angle−8)+DP/2×cos(loft angle) where, Rb: ball radius (21.4 mm), and Dp: strike mark diameter (15 mm);

the upper portion is arranged upper than the height (H) obtained by the equation as a boundary;

a thickness of the upper portion, excluding a circumferential edge, is formed thinner than a thickness of the lower portion, the thickness of the upper portion being made to be 1±0.2 mm (0.8 to 1.2 mm); and the at least one rib divides the upper portion into two equal areas, wherein the at least one rib has a width of 5 mm and a thickness of 3 mm.

2. The iron club head according to claim 1, wherein the at least one rib is arranged on a back of the upper portion which has the thickness of 1±0.2 mm (0.8 to 1.2 mm).

3. The iron club head according to claim 1, wherein the thickness of the upper portion is made to be between 0.8 to 1.0 mm.

4. The iron club head according to claim 1, wherein the upper portion has a constant thickness.

5. An iron club head for an iron golf club, comprising:

an upper portion of a face member;

a lower portion of the face member, and at least one rib that connects the circumferential edge of the upper portion with the lower portion, wherein:

a maximum height (H) on the face member at which a ball is to be hit is obtained by an equation: H=Rb×(1−sin(loft angle−8)+DP/2×cos(loft angle) where, Rb corresponds to a ball radius, and Dp corresponds to a strike mark diameter;

the upper portion is arranged upper than the height (H) obtained by the equation as a boundary;

a thickness of the upper portion, excluding a circumferential edge, is formed thinner than a thickness of the lower portion, the thickness of the upper portion being made to be 1±0.2 mm (0.8 to 1.2 mm); and a plurality of ribs which connect the circumferential edge of the upper portion with the lower portion divide the upper portion into three equal areas; and wherein each of the plurality of ribs has a width of 3 mm and a thickness of 3 mm.

6. The iron club head according to claim 5, wherein each of the plurality of ribs is arranged on a back of the upper portion which has the thickness of 1±0.2 mm (0.8 to 1.2 mm).

7. The iron club head according to claim 5, wherein the thickness of the upper portion is made to be between 0.8 to 1.0 mm.

8. The iron club head according to claim 5, wherein the upper portion has a constant thickness.

* * * * *